US006536343B2

(12) United States Patent
Onuma

(10) Patent No.: US 6,536,343 B2
(45) Date of Patent: Mar. 25, 2003

(54) PRINTING PRESS HAVING DETACHABLE ADJUSTER FOR POSITIONING PLATE MAKING UNIT

(75) Inventor: Kyotaro Onuma, Ibaraki (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/861,061

(22) Filed: May 17, 2001

(65) Prior Publication Data

US 2001/0042474 A1 Nov. 22, 2001

(30) Foreign Application Priority Data

May 17, 2000 (JP) ..... 2000-145540

(51) Int. Cl.[7] ..... B41C 1/05

(52) U.S. Cl. ..... 101/401.1; 101/463.1; 101/141; 101/480

(58) Field of Search ..... 101/463.1, 467, 101/141, 142, 401.1, 485, 486, 480; 347/8

(56) References Cited

U.S. PATENT DOCUMENTS 5,148,746 A * 9/1992 Fuller et al. ..... 101/142
5,385,092 A * 1/1995 Lewis et al. ..... 101/453
5,419,255 A * 5/1995 Reffert ..... 101/375
5,492,057 A * 2/1996 Bornhors et al. ..... 101/401.1
2002/0018111 A1 * 2/2002 Ikematsu ..... 347/248

FOREIGN PATENT DOCUMENTS

JP 11-314353 11/1999

* cited by examiner

*Primary Examiner*—Leslie J. Evanisko
(74) *Attorney, Agent, or Firm*—Blakely Sokoloff Taylor & Zafman

(57) ABSTRACT

A printing press includes a plate cylinder, a plate making unit, and an adjuster. The plate cylinder is rotatably supported by a frame and has an outer surface on which a plate is mounted. The plate making unit performs plate making for the plate mounted on the plate cylinder. The plate making unit has a support member supported by the frame and an exposure unit. The exposure unit is supported by the support member to be movable in a direction to come close to and separate from the outer surface of the plate cylinder, and has a head which irradiates the plate with a laser beam to print an image on the plate. The adjuster is supported by the plate making unit to be detachable to adjust a position of the exposure unit with respect to the support member.

11 Claims, 15 Drawing Sheets

PRINTING PRESS HAVING DETACHABLE ADJUSTER FOR POSITIONING PLATE MAKING UNIT

BACKGROUND OF THE INVENTION

The present invention relates to a printing press with a plate making unit for performing plate making for a plate mounted on the plate cylinder of a printing unit.

Generally, when performing plate making for a plate, it is required to increase the efficiency of plate making operation and to eliminate the space where a plate making unit is to be installed. Hence, in recent years, a plate making unit independent of the printing press is not provided, but a plate making unit added to the printing press itself performs plate making directly on the printing press. More specifically, a plate before plate making is mounted on a plate cylinder in a printing unit, and the plate making unit is moved to abut its head against the plate cylinder. Subsequently, the plate cylinder is rotated, and simultaneously the head is moved in the axial direction of the plate cylinder, thereby performing plate making for the plate. When the plate is to be supplied/removed or maintenance is to be performed, the plate making unit is separated from the printing unit, and the head is removed from a support member.

When performing plate making operation, the head must be attached to the support member again, and the position of the head with respect to the plate cylinder is not always the same as the position where the head has been removed from the support member. Therefore, since the distance between the head and plate cylinder is not made equal to a predetermined distance when the plate making unit comes close to the plate cylinder, the position of the head with respect to the plate cylinder varies, thereby degrading plate making precision and causing defective plate making.

SUMMARY OF THE INVENTION

It is an object of the present invention to provide a printing press which prevents defective plate making by improving plate making precision.

In order to achieve the above object, according to the present invention, there is provided a printing press comprising a plate cylinder which is rotatably supported by a frame and has an outer surface on which a plate is mounted, a plate making unit for performing plate making for the plate mounted on the plate cylinder, the plate making unit having a support member supported by the frame and an exposure unit supported by the support member to be movable in a direction to come close to and separate from the outer surface of the plate cylinder, the exposure unit being provided with a head which irradiates the plate with a laser beam to print an image on the plate, and an adjuster supported by the plate making unit to be detachable to adjust a position of the exposure unit with respect to the support member.

DESCRIPTION OF THE PREFERRED EMBODIMENT

The present invention will be described in detail with reference to the accompanying drawings.

Figure 1:
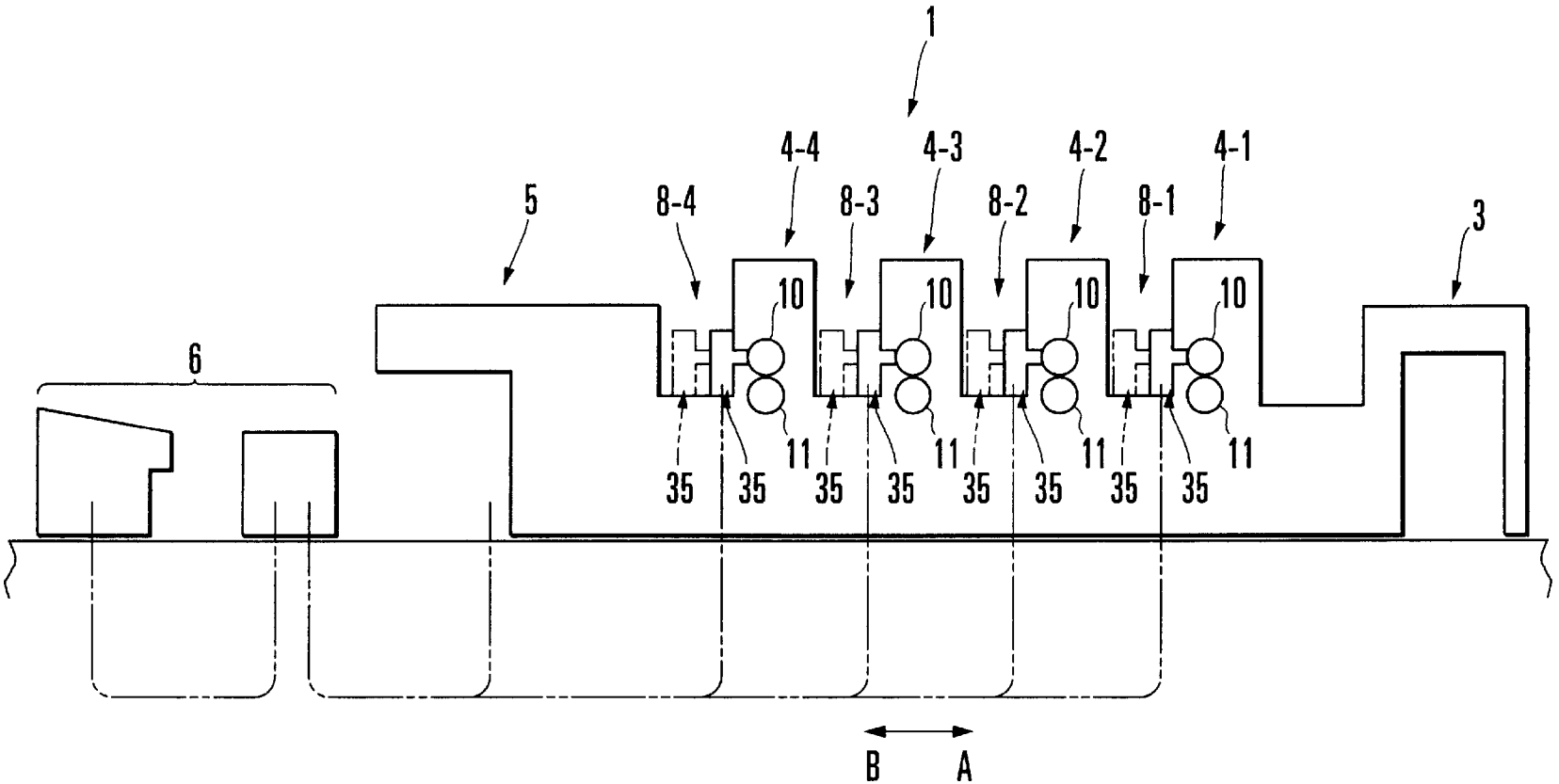
FIG. 1 is a side view schematically showing a printing press according to an embodiment of the present invention.

FIG. 1 schematically shows a printing press according to an embodiment of the present invention. Referring to FIG. 1, a printing press 1 is comprised of a feed unit 3 for feeding paper sheets one by one, four printing units 4-1, 4-2, 4-3, and 4-4 sequentially arranged in the sheet convey direction to print the sheets fed from the feed unit 3 for the respective ink colors, a delivery unit 5 for delivering the sheets printed by the printing units 4-1 to 4-4, and a control unit 6 for controlling the entire printing press 1.

The printing press 1 is operated selectively at the first speed at which sheets are supplied from the feed unit 3 to enable printing, and the second speed lower than the first speed. At the second speed, no sheets are supplied from the feed unit 3, and a blanket applied on the blanket cylinder or the plate is changed. Also, in order to check whether the printing pressure between the blanket cylinder and impression cylinder is appropriate, maintenance in which, e.g., printing is performed to check the printing pressure is performed.

Figure 4A:
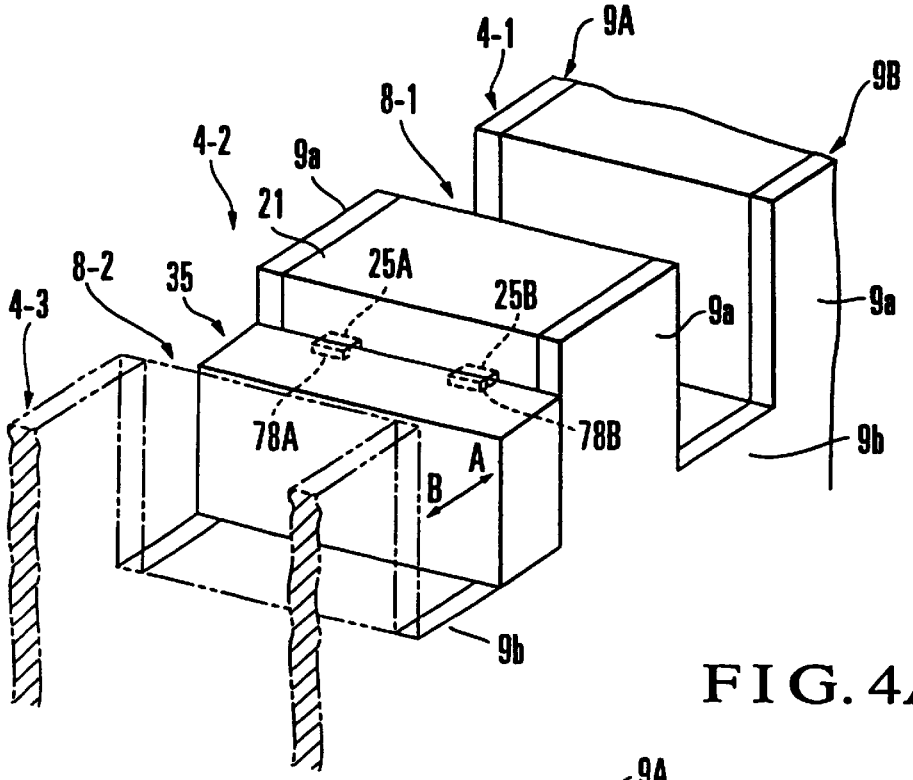
FIG. 4A is a perspective view of a printing unit the opening of which is closed with the plate making unit shown in FIG. 2A.
Figure 4B:
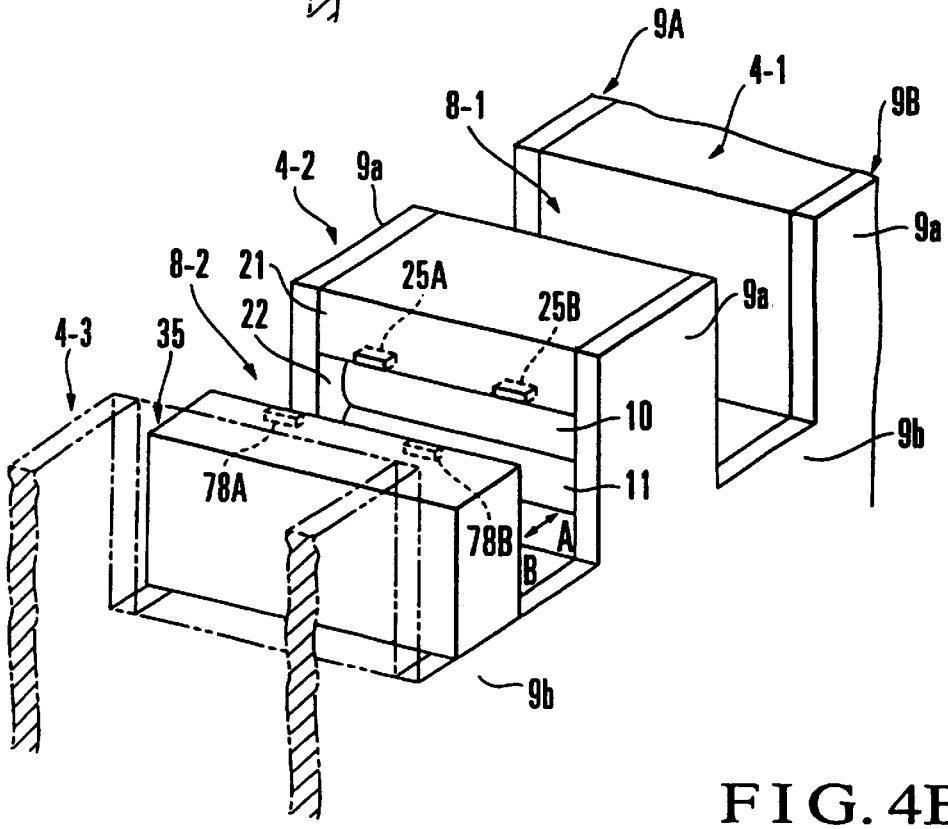
FIG. 4B is a perspective view of the printing unit the opening of which is open.
Figure 5:
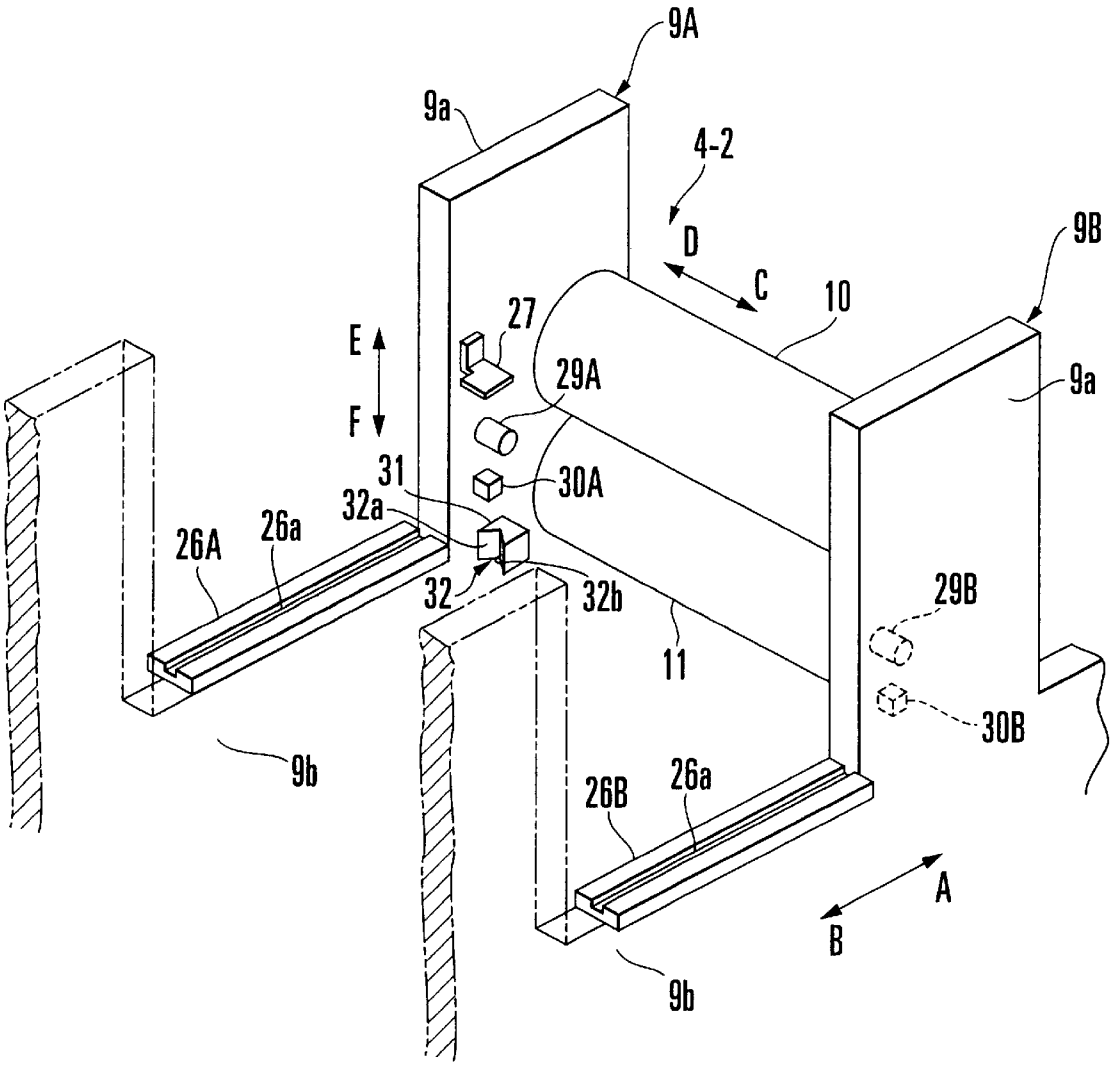
FIG. 5 is a perspective view of the printing unit from which a cover and the plate making unit are removed.

Work spaces 8-1, 8-2, 8-3, and 8-4, where plate change and maintenance of the inking unit and the like are performed, are provided between the four printing units 4-1 to 4-4 and between the printing unit 4-4 and delivery unit 5. The inking unit (not shown) with a roller group, a dampening unit (not shown), and a plate cylinder 10, blanket cylinder 11, an impression cylinder (not shown) and the like rotatably supported between a pair of frames 9A and 9B (FIG. 5), are provided in each of the printing units 4-1 to 4-4. As shown in FIGS. 4A, 4B, and 5, each of the frames 9A and 9B has high-wall portions 9*a* and low-wall portions 9*b* alternately like comb teeth at its upper portion.

Figure 2A:
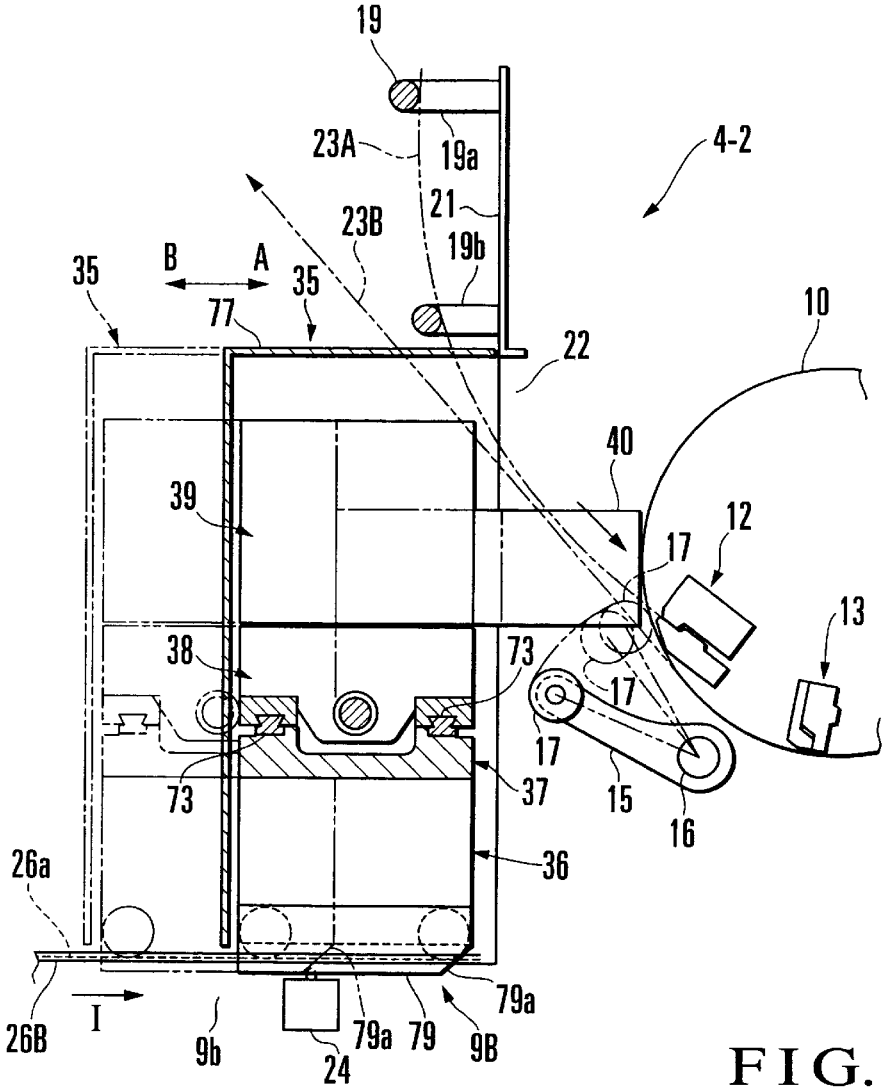
FIG. 2A is a partially sectional side view of the main part of the printing press of FIG. 1.

As all of the printing units 4-1 to 4-4 have the same structure, the printing unit 4-2 and a plate making unit 35 attached to it will be described hereinafter. Referring to FIG. 2A, a notch (not shown) is formed in the outer surface of the plate cylinder 10 to extend in an axial direction (a direction perpendicular to the sheet convey direction). A leading edge plate clamping unit 12 for clamping the leading edge of the plate and a trailing edge plate clamping unit 13 for clamping the trailing edge of the plate are provided in this notch. A pair of levers 15 are swingably supported by the frames 9A and 9B through a shaft 16. Guide rollers 17 extending in the axial direction of the plate cylinder 10 are axially supported at the distal ends of the levers 15.

The levers 15 are driven to swing by a driving unit (not shown). When the levers 15 swing, the guide rollers 17 reciprocally move in a direction to come close to and separate from the outer surface of the plate cylinder 10. Hence, the guide rollers 17 are positioned. at a wait position (solid line), a guide position (an alternate long and two short dashed line) where they guide an old plate 23B in plate removal, and a plate mounting position (an alternate long and a short dashed line) where they come in contact with the outer surface of the plate cylinder 10 and mount a new plate 23A on the outer surface of the plate cylinder 10.

A U-shaped guide member 19 for mounting the new plate and cantilevered by a pair of legs 19*a* and 19*b* are attached to the front surface (in sheet convey direction) of an upper cover 21 that closes the upper portion of the printing unit 4-2. The guide member 19 guides the new plate 23A inserted in the leading edge plate clamping unit 12 of the plate cylinder 10. An opening 22 is formed below the upper cover 21 of the printing unit 4-2, that is, in the front surface of the plate cylinder 10. Plate change and maintenance of rollers and the like are performed through the opening 22.

Figure 2B:
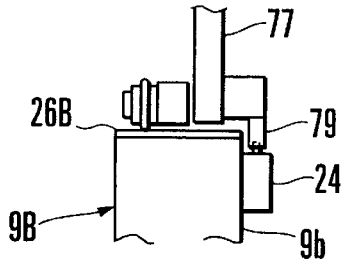
FIG. 2B is a view seen in the direction of arrow I of FIG. 2A.

As shown in FIG. 2B, a detection switch 24 is attached to the low-wall portion 9*b* of the frame 9B. The detection switch 24 detects that the plate making unit 35 has moved from the operative position where it performs plate making to the wait position (inoperative position) where plate change operation is possible, as will be described later.

As shown in FIGS. 4A and 4B, a pair of plate making unit ON/OFF detection sensors 25A and 25B are attached to the lower end of the front surface of the upper cover 21 above the opening 22 to oppose the plate making unit 35. As shown in FIG. 5, guide members 26A and 26B are fixed to the respective upper end faces of the low-wall portions 9*b* of the frames 9A and 9B. Guide grooves 26*a* extending in the sheet convey direction (direction of arrows A–B) are formed in the upper surfaces of the guide members 26A and 26B. A home position dog 27 is fixed to the inner surface, closer to the sheet convey direction, of the high-wall portion 9*a* of the frame 9A. An almost cubic engaging block 31 serving as a regulating means is fixed under the home position dog 27.

A vertically extending V-shaped engaging recess 32 is formed on the end face, in the sheet convey direction, of the engaging block 31. The engaging recess 32 is formed of slant surfaces 32*a* and 32*b* slanting to one side and the other side, respectively, in the axial direction (direction of arrows C–D) of the plate cylinder 10. As the engaging recess 32 is formed V-shaped, the distance between the slant surfaces 32*a* and 32*b* gradually decreases in the moving direction (direction of arrow A) of the plate making unit 35 toward the operative position.

Circular cylindrical engaging pins 29A and 29B project on the inner surfaces of the high-wall portions 9*a* of the frames 9A and 9B to oppose each other at a position between the home position dog 27 and engaging block 31. Engaging projections 30A and 30B are fixed under the respective engaging pins 29A and 29B.

The plate making unit 35 will be described.

Referring to FIG. 2A, the plate making unit 35 has a base unit 36, a stage 37 fixed on the base unit 36, a table 38 movable on the stage 37 in the axial direction of the plate cylinder 10, and an exposure unit 39 with a head 40 and integrated on the table 38 to perform plate making for the plate. The exposure unit 39 irradiates (exposes) the plate cylinder 10 with a laser beam from its head 40, while moving in the axial direction of the plate cylinder 10, to print an image on the entire plate mounted on the plate cylinder 10.

The base unit 36 of the plate making unit 35 will be described with reference to FIGS. 7A and 7B, 8, 9, and 10A, 10B, and 10C.

Figure 8:
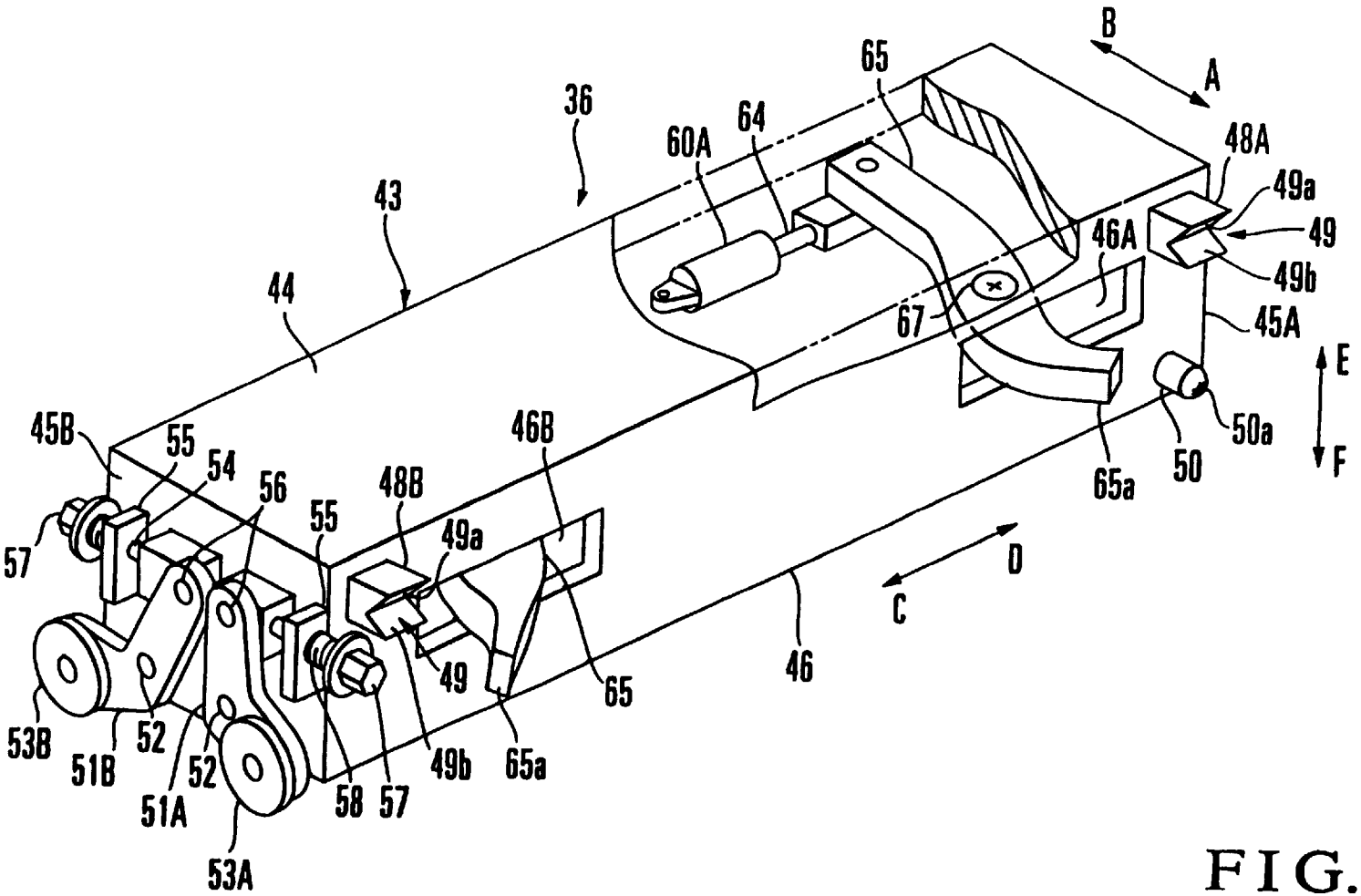
FIG. 8 is a perspective view of the base unit shown in FIG. 7A.

Referring to FIG. 8, the base unit 36 has a box-like base frame 43 extending in the axial direction (direction of arrows C–D) of the plate cylinder 10. The base frame 43 is comprised of a rectangular upper plate 44, a pair of side plates 45A and 45B, and a front plate 46 having windows 46A and 46B. The upper plate 44 and front plate 46 form an L-shaped section. Almost cubic engaging blocks 48A and 48B serving as regulating means are fixed to the upper corners at the two ends of the front plate 46.

An engaging recess 49 is formed in the front end face of each of the engaging blocks 48A and 49B to extend in a V shape in the horizontal direction. The engaging recess 49 is formed of an upper slant surface 49*a* facing obliquely upward and a lower slant surface 49*b* facing obliquely downward. As the engaging recess 49 is formed V-shaped, the distance (opening of the recess) between the upper and lower slant surfaces 49*a* and 49*b* decreases in the moving direction (direction of arrows A–B) of the plate making unit 35 toward the operative position.

Figure 7B:
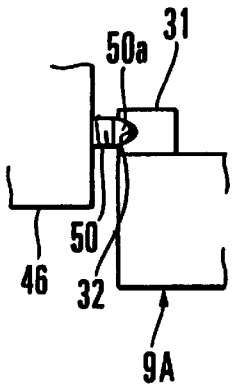
FIG. 7B is a view seen in the direction of arrow II of FIG. 7A.
Figure 7A:
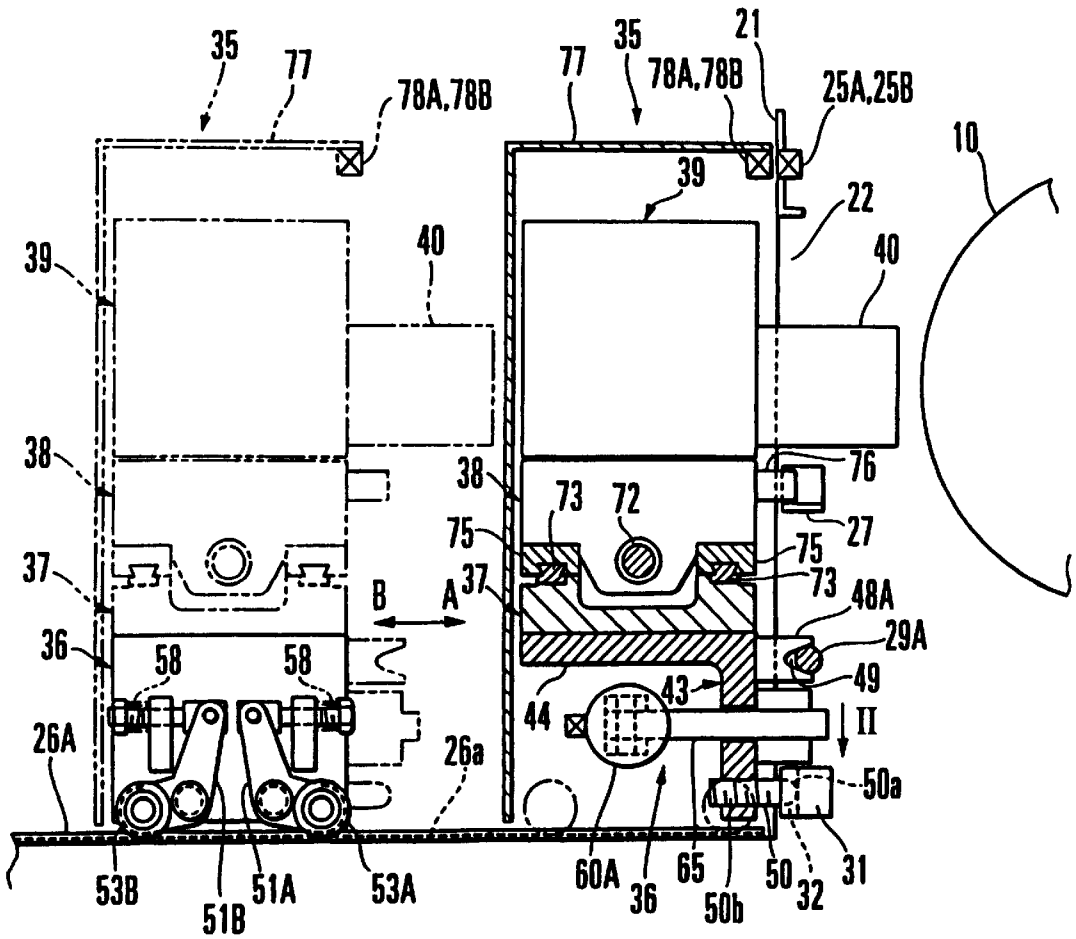
FIG. 7A is a partially cutaway side view of the plate making unit shown in FIG. 2A.

As shown in FIG. 7A, engaging pins 29A and 29B engage with the engaging recesses 49 of the engaging blocks 48A and 48B, respectively. This regulates the movement of the plate making unit 35 in the vertical direction (direction of arrows E–F), so the plate making unit 35 is positioned with respect to the plate cylinder 10 in the vertical direction (direction of arrows E–F). Since the engaging blocks 48A and 48B engageable with the engaging pins 29A and 29B are formed in this manner at the two ends of the plate making unit 35, the plate making unit 35 is positioned without being slanted in the longitudinal direction. Thus, the plate making unit 35 is positioned accurately, high-precision plate making is enabled, and the printing quality is improved.

Referring to FIGS. 7A and 7B, an engaging pin 50 has a threaded portion 50*b* at its base and a hemispherical distal end portion 50*a*. The threaded portion 50*b* threadably engages with that portion of the front plate 46 of the base frame 43 which is below the engaging block 48A, so the distal end portion 50*a* projects. The distal end portion 50*a* of the engaging pin 50 engages with the engaging recess 32 of the engaging block 31. This regulates the movement of the plate making unit 35 in the axial direction (direction of arrows C–D) of the plate cylinder 10, so the plate making unit 35 is positioned with respect to the plate cylinder 10.

When the engaging pin 50 is rotated, it moves forward toward or backward from the front plate 46 to adjust the position of its distal end portion 50*a*. In this manner, the verticality of the plate making unit 35 is adjusted. As the distal end portion 50*a* of the engaging pin 50 is hemispherical, despite the rotation of the engaging pin 50, it is held while it correctly engages with the engaging recess 32 of the engaging block 31. As a result, the direction of the plate making unit 35 perpendicular to the sheet convey direction, and the verticality of the plate making unit 35 are adjusted correctly by cooperation of the engaging pin 50 and engaging block 31.

Figure 10A:
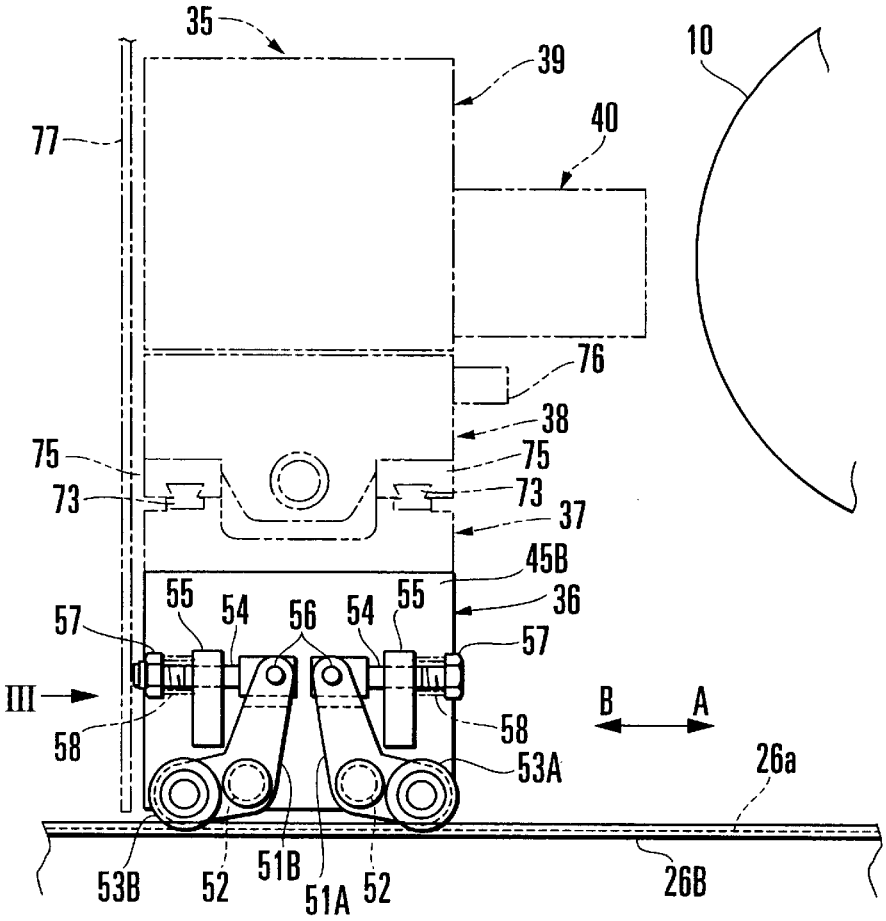
FIG. 10A is a side view of the plate making unit shown in FIG. 2A.
Figure 10B:
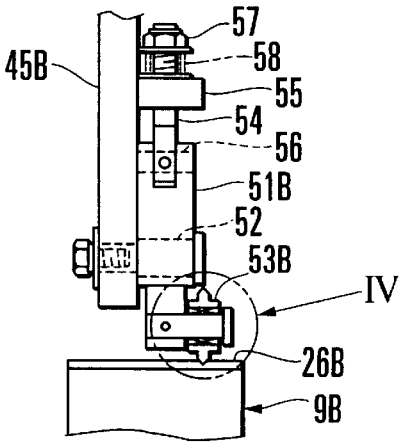
FIG. 10B is a view seen in the direction of arrow III of FIG. 10A.

As shown in FIG. 10A, two pairs of castors 53A and 53B engageable with the guide grooves 26*a* of the guide members 26A and 26B are attached to the pair of side plates 45A and 45B of the base frame 43. A substantially L-shaped lever 51A and inverted L-shaped lever 51B are rotatably supported by each of the side plates 45A and 45B through pins 52 at their central portions. The castors 53A and 53B are pivotally supported at the lower ends of the levers 51A and 51B, respectively. Slide shafts 54 are inserted in the through holes of spring bearing members 55 fixed to the side plates 45A and 45B. One end of each slide shaft 54 is pivotally attached to each one of the upper ends of each lever 51A and 51B through a pin 56.

Figure 10C:
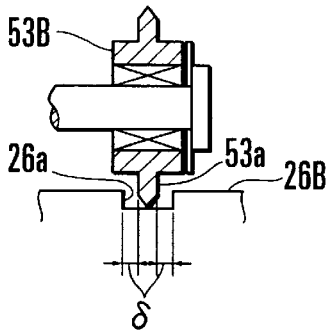
FIG. 10C is an enlarged view of a portion IV of FIG. 10B.

A nut 57 threadably engages with a threaded portion at the other end of each slide shaft 54. A compression coil spring 58 is elastically mounted between the nut 57 and spring bearing member 55. The spring forces of the compression coil springs 58 bias the lever 51A clockwise in FIG. 10A about the corresponding pin 52 as the center of pivot, and the lever 51B counterclockwise in FIG. 10A about the corresponding pin 52 as the center of pivot. Thus, the plate making unit 35 is supported to be movable between the operative and wait positions against its own weight and to be adjustable in the vertical direction. As shown in FIG. 10C, a narrow, ring-like engaging wheel 53*a* is integrally formed on the outer surface of each of the castors 53A and 53B. The width of the guide groove 26*a* of each of the guide members 26A and 26B is formed larger than the width of the engaging wheel 53*a* by 2δ.

Figure 9:
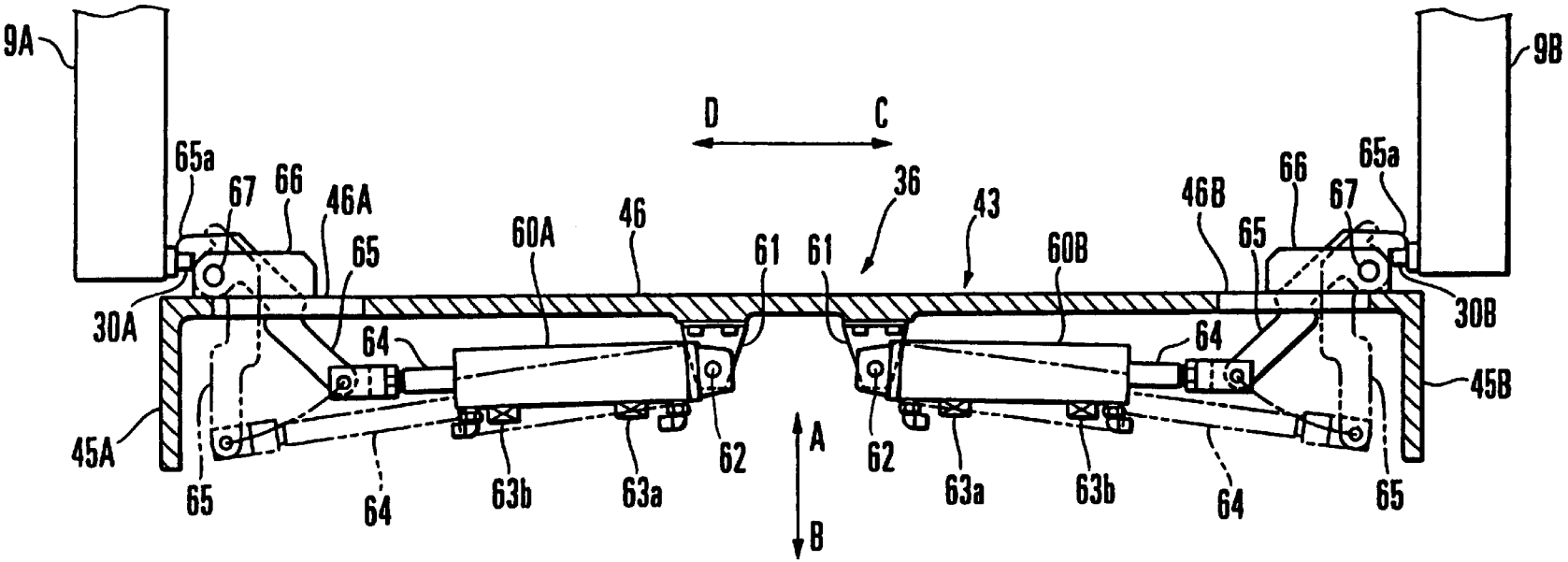
FIG. 9 is a longitudinal sectional view of the base unit shown in FIG. 8.

As shown in FIG. 9, a pair of actuators 60A and 60B are pivotally mounted on brackets 61 through pins 62, fixed to the lower surface of the front plate 46 of the base frame 43, to oppose each other. A fixed state detection sensor 63*a* and a fixed state release detection sensor 63*b* are attached to each of the actuators 60A and 60B to detect forward/backward movement of a corresponding rod 64. One end of a lever 65 is pivotally mounted ion the distal end of each rod 64. The other end of the lever 65 projects from the window 46A and 46B outside the base frame 43, and is pivotally mounted on a bracket 66 fixed to the outside of the front plate 46 through a pin 67.

Each lever 65 has a hook 65*a* on its other end. When the rods 64 move backward, the corresponding hooks 65*a* engage with the engaging projections 30A and 30B, respectively, and the base unit 36 is fixed to the frames 9A and 9B. Simultaneously, the fixed state detection sensors 63*a* detect that the base unit 36 is fixed. When the rods 64 move forward, the hooks 65*a* of the levers 65 and the engaging projections 30A and 30B are disengaged from each other. Simultaneously, the fixed state release detection sensors 63*b* detect that the fixed base unit 36 is released.

In this manner, the actuators 60A and 60B have both the function of fixing the plate making unit 35 to the frames 9A and 9B and the function of detecting that the plate making unit 35 is fixed or released. As members that take charge of the two functions can be shared, not only the number of components is reduced, but also the structure is simplified.

The moving structure of the exposure unit 39 in the axial direction (direction of arrows C–D) of the plate cylinder 10 will be described with reference to FIGS. 7A, 11, 12, and 14.

Figure 11:
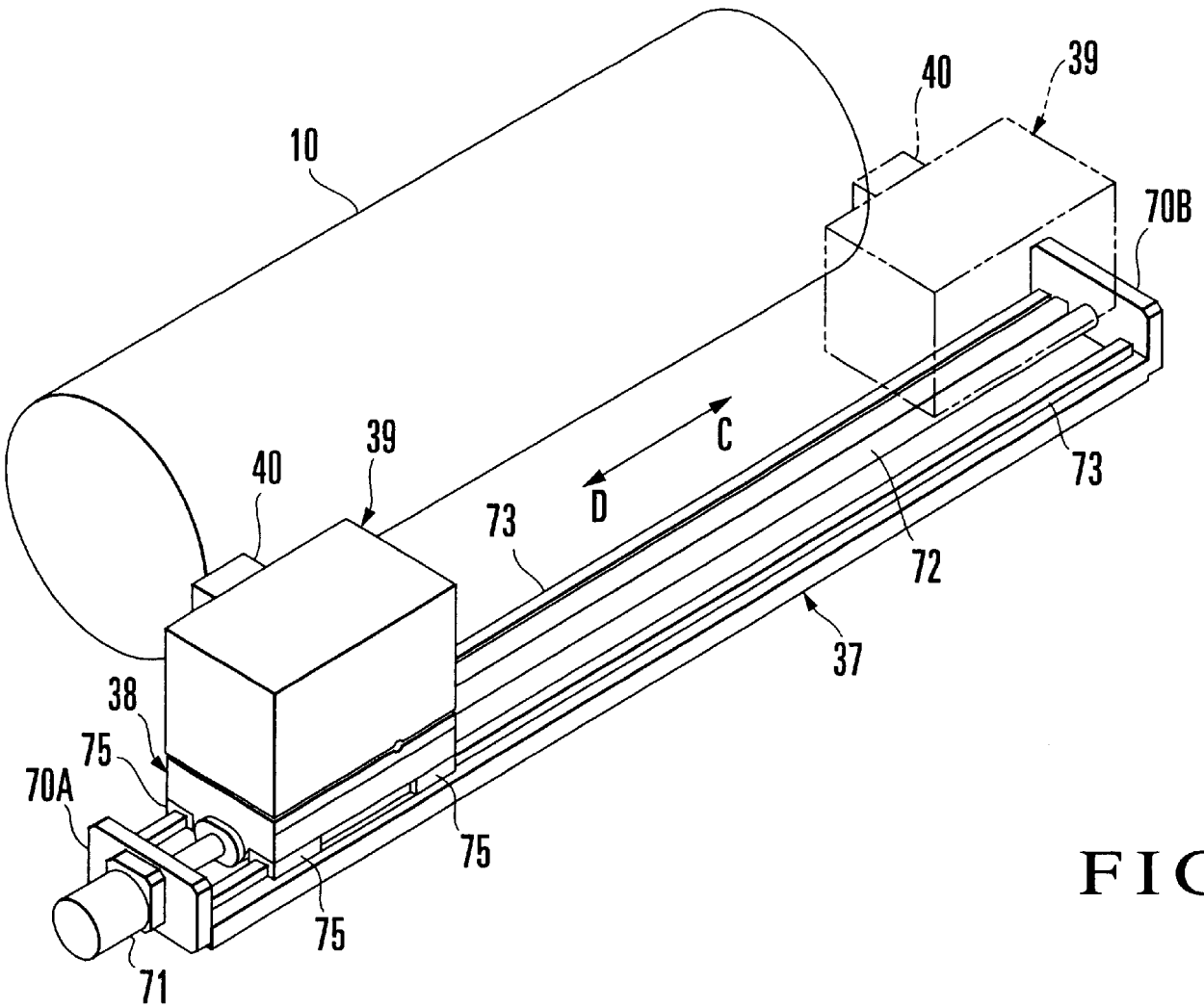
FIG. 11 is a perspective view, seen from the rear side, of the guide structure of an exposure unit.

Referring to FIG. 7A, the stage 37 extends in the axial direction of the plate cylinder 10 and is fixed on the upper plate 44 of the base frame 43. As shown in FIG. 11, a pair of opposing side plates 70A and 70B are provided upright at the two ends of the stage 37. A motor 71 which is selectively driven in the forward/reverse direction is fixed to the side plate 70A. Rotation of the motor shaft of the motor 71 is transmitted to a ball screw 72 which is rotatable between the side plates 70A and 70B and the movement of which in the axial direction is regulated.

Figure 12:
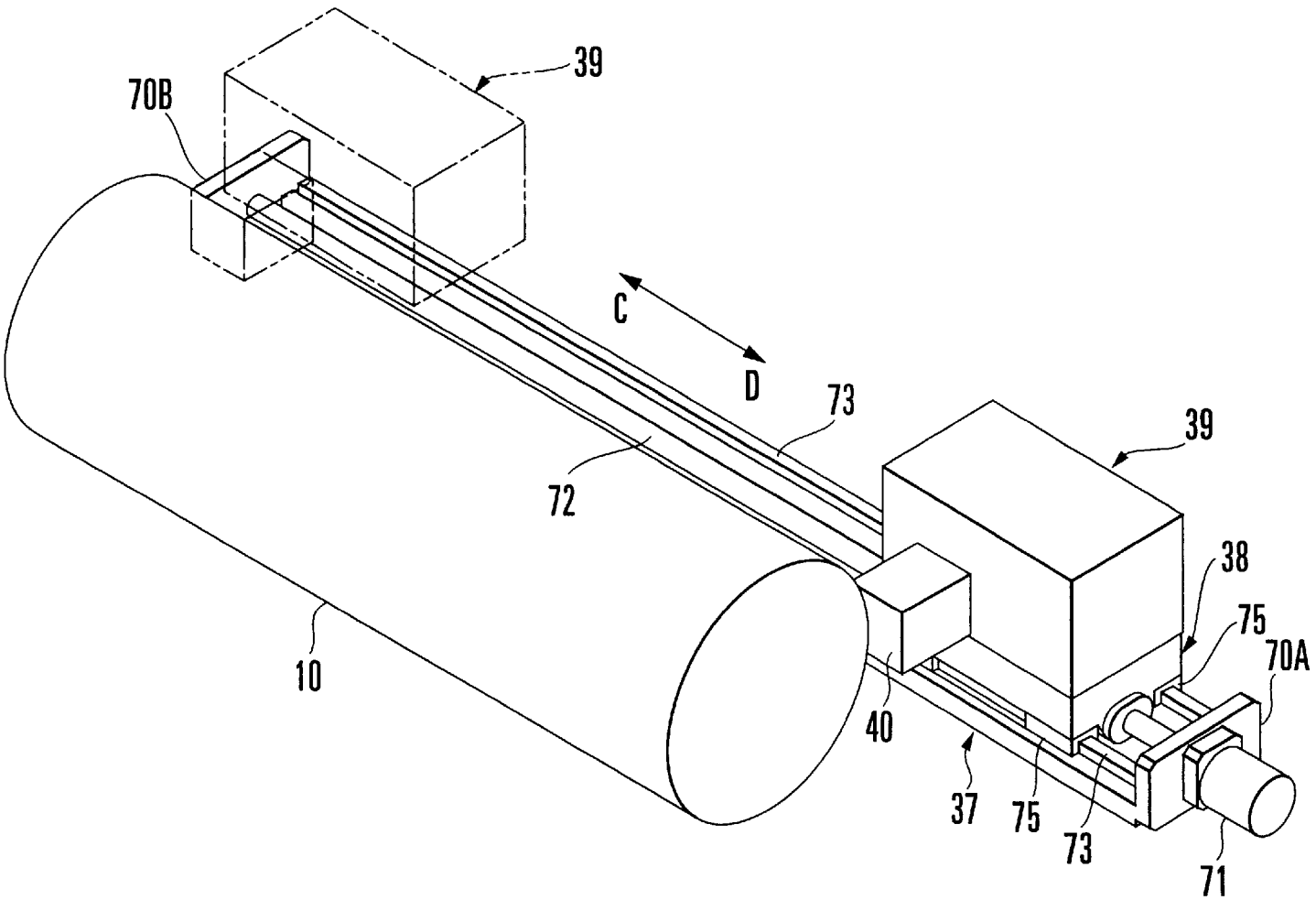
FIG. 12 is a perspective view, seen from the front side, of the guide structure of the exposure unit.
Figure 14:
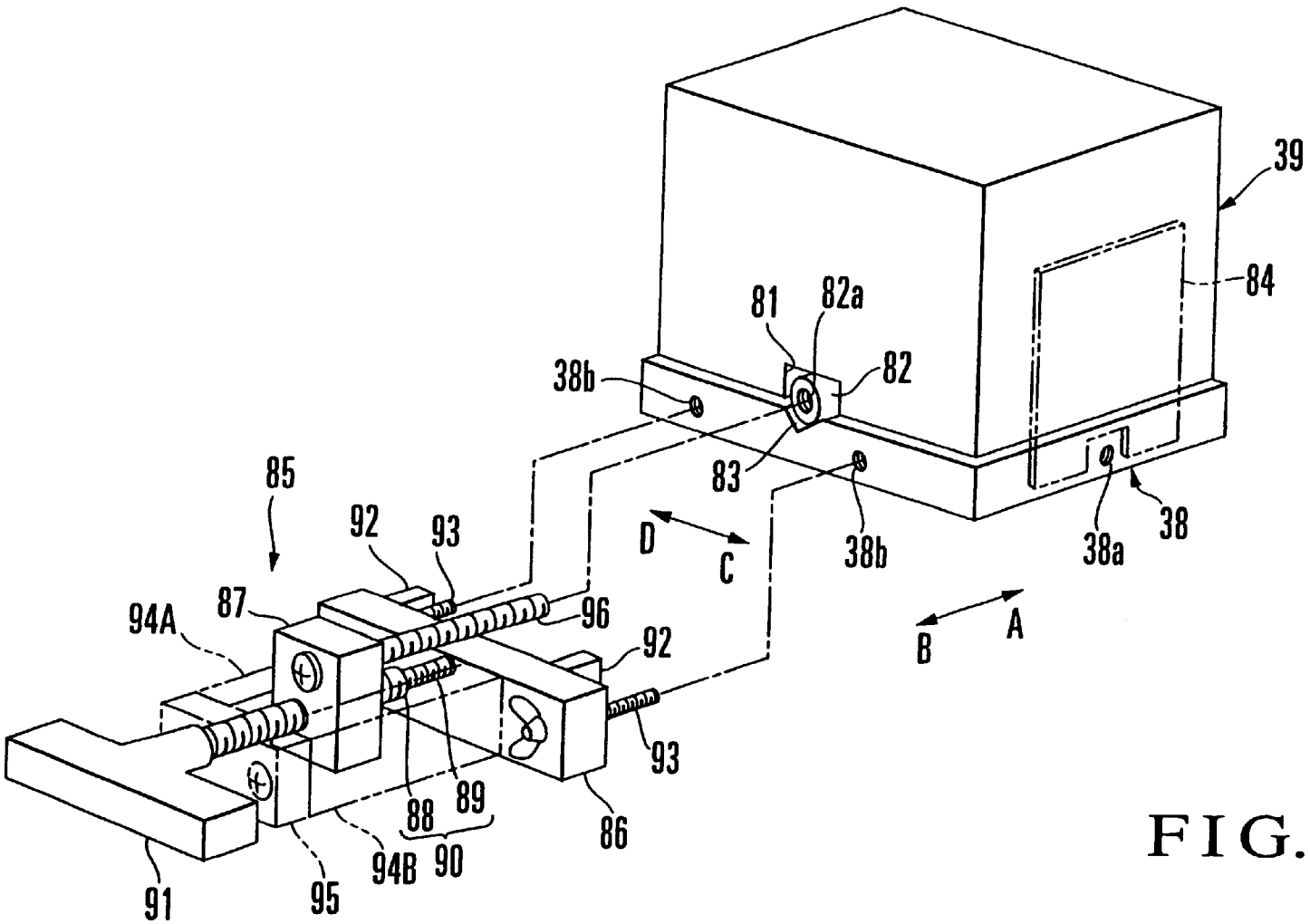
FIG. 14 is an enlarged perspective view of the position adjusting mechanism of the exposure unit.

A pair of parallel rails 73 are mounted on the upper surface of the stage 37 so as to extend in the axial direction (direction of arrows C–D) of the plate cylinder 10 at a predetermined distance from each other. As shown in FIG. 12, four sliders 75 are fixed to the lower surface of the table 38 such that they fit on the corresponding rails 73 and guide the table 38 along the rails 73 in the direction of arrows C–D. As shown in FIG. 14, screw holes 38*a* to threadably engage with the ball screw 72 are formed in the side end faces of the table 38 to extend through them in the axial direction of the plate cylinder 10. When the motor 71 is driven in the forward/reverse direction, the table 38 moves in the direction of arrows C–D through the ball screw 72.

Figure 3:
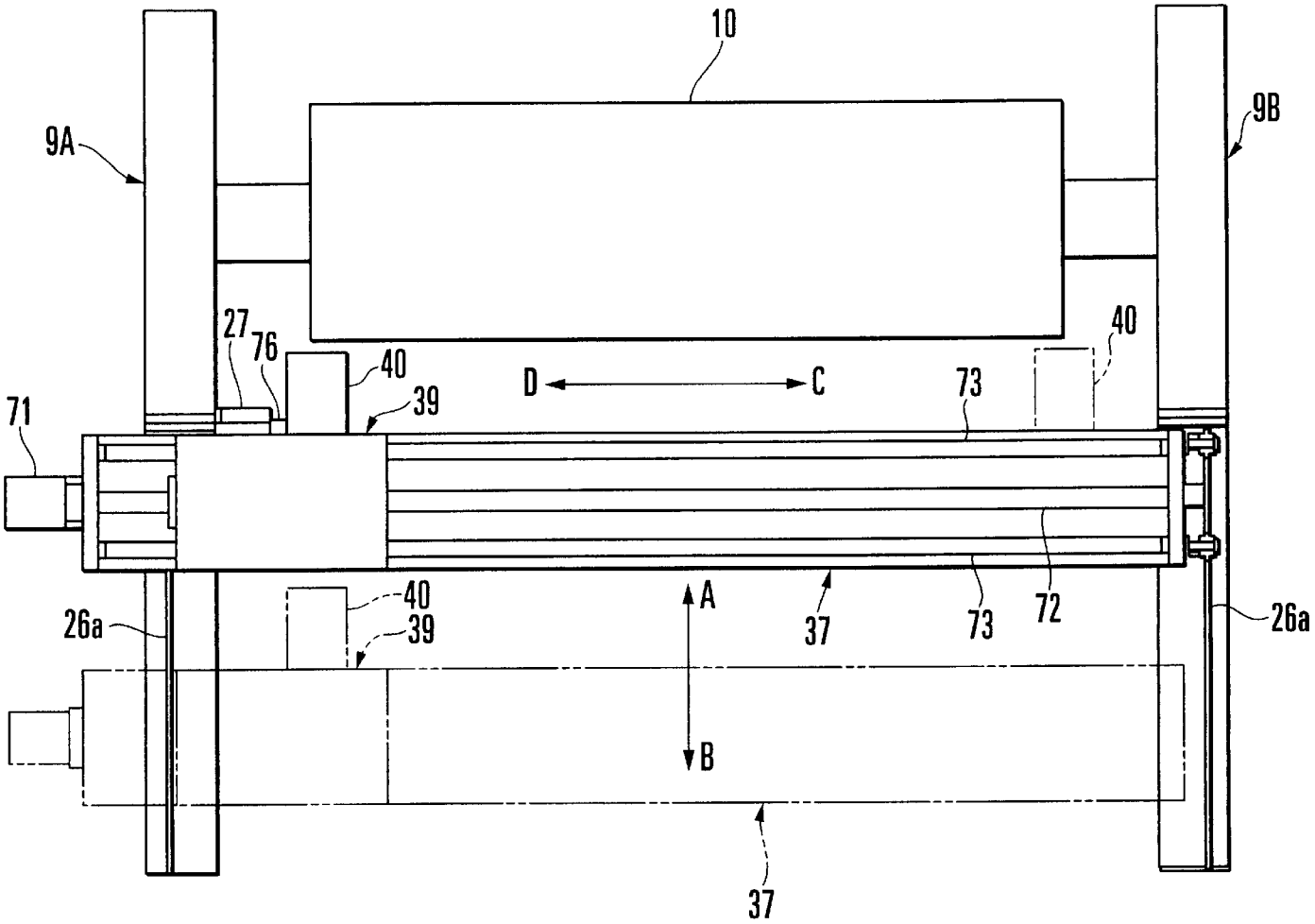
FIG. 3 is a plan view of the main part of the printing press shown in FIG. 1.

The exposure unit 39 is placed on the table 38 to be movable in the sheet convey direction, i.e., in a direction (direction of arrows A–B) to come close to and separate from the plate cylinder 10. The exposure unit 39 is fixed to the table 38 with a pair of clamp plates 84 (FIG. 14; to be described later), and moves together with the table 38. As shown in FIG. 3, an exposure unit home position sensor 76 for detecting the home position dog 27 fixed to the frame 9A is attached to the table 38. When the motor 71 drives the plate making unit 35 to move in the direction of arrow D, the exposure unit home position sensor 76 detects the home position dog 27. Upon detection of the home position dog 27, movement of the plate making unit 35 is stopped, and an exposure start position where the plate mounted on the plate cylinder 10 is to be exposed by the head 40 is determined.

In this manner, when the exposure start position for the plate is determined by the exposure unit home position sensor 76, exposure always starts at the same position, so a position error in plate making can be prevented. In addition, since the home position dog 27 is fixed to the frame 9A and the exposure unit home position sensor 76 is fixed to the table 38, the position of the head 40 in the axial direction of the plate cylinder 10 can be detected with reference to the frame 9A. Hence, the position of the head 40 can be correctly detected without being influenced by the position precision of the plate making unit 35 at the operative position and the position precision of the head 40 with respect to the plate making unit 35. As a result, high-precision plate making is enabled, and the printing quality is improved.

Figure 6:
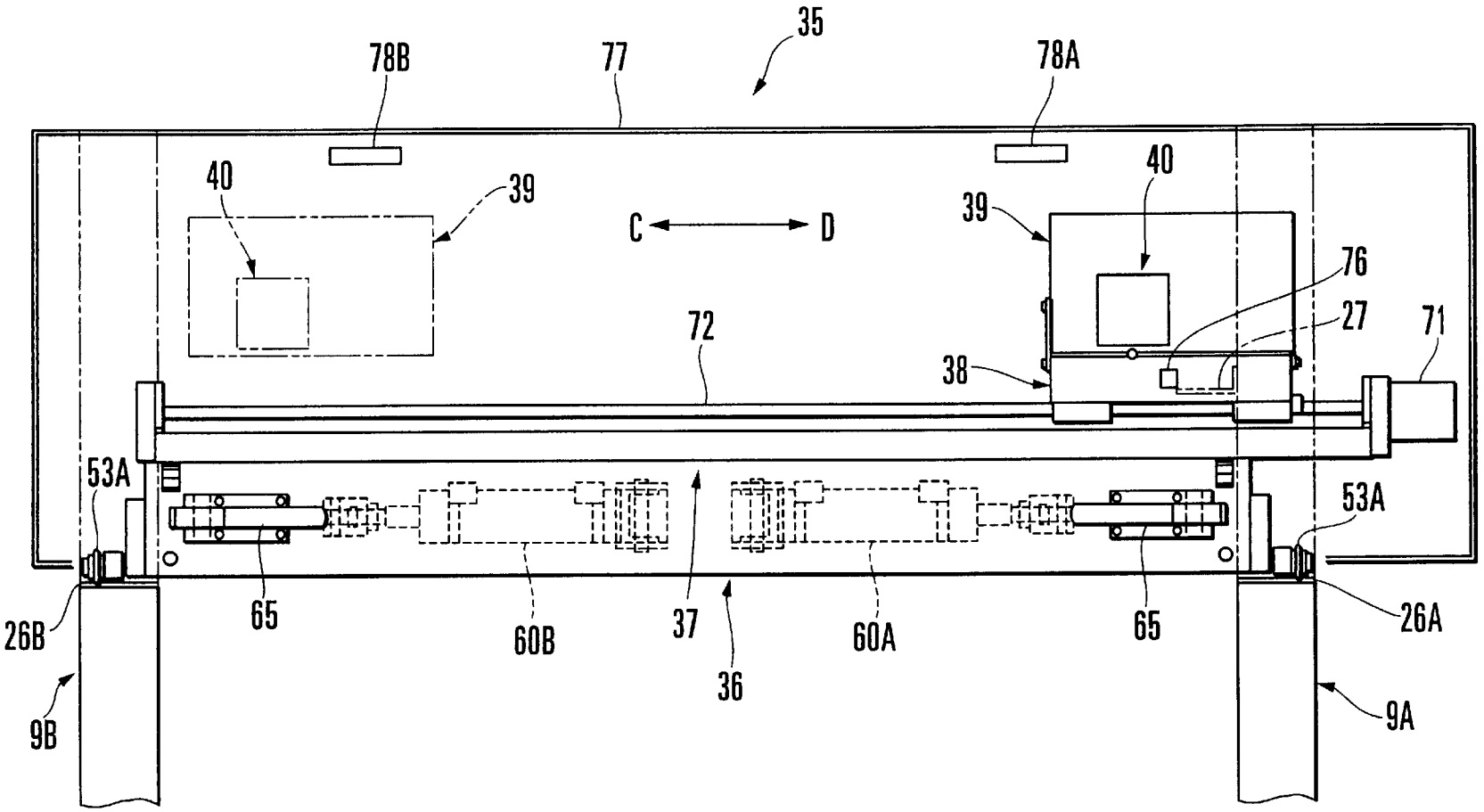
FIG. 6 is a front view of the plate making unit shown in FIG. 2A.

As shown in FIG. 6, a pair of detection target members 78A and 78B are attached to the upper portion of the front surface of a cover 77 that closes the plate making unit 35 entirely. As shown in FIGS. 4A and 4B, when the plate making unit 35 comes close to the printing unit 4-2 and closes its opening 22, the detection target members 78A and 78B are detected by the plate making unit ON/OFF detection sensors 25A and 25B. In other words, the plate making unit ON/OFF detection sensors 25A and 25B and the detection target members 78A and 78B detect that the plate making unit 35 is located at the operative position. For example, the detection target members 78A and 78B are formed of light-emitting elements, and the plate making unit ON/OFF detection sensors 25A and 25B are formed of light-receiving elements. When it is detected that the plate making unit 35 is located at the operative position, the control unit 6 sets the printing press 1 in the print mode. When it is not detected that the plate making unit 35 is located at the operative position, the control unit 6 sets the printing press 1 in the non-print mode.

As shown in FIGS. 2A and 2B, a cam 79 for actuating the detection switch 24 is attached to the lower end of the cover 77 on the frame 9B side. The cam 79 has a notch 79*a* at its rear end. With this arrangement, the plate making unit 35 moves from the operative position, indicated by a solid line and where it performs plate making, in a direction (direction of arrow B) to separate from the plate cylinder 10, and is positioned at the inoperative position indicated by an alternate long and two short dashed line and where it awaits in plate change. At this time, the notch 79*a* of the cam 79 opposes the detection switch 24. When the detection switch 24 detects the notch 79*a*, the control unit 6 allows the printing press 1 to perform plate change.

The structure for finely adjusting the exposure unit 39 in the direction (direction of arrows A–B) to come close to and separate from the plate cylinder 10 will be described with reference to FIGS. 13A, 13B, and 14.

As shown in FIG. 14, a groove 81 with a rectangular section and extending in the direction of arrows A–B is formed at the center of the lower end face of the exposure unit 39. A cylindrical pipe 82 with a screw hole 82*a* is fixed in the groove 81. A groove 83 with a V-shaped section and extending in the direction of arrows A–B is formed at the center of the upper surface of the table 38 to correspond to the groove 81. The exposure unit 39 is detachably placed on the table 38 such that the pipe 82 is accommodated in the groove 83. The pair of clamp plates 84 are arranged on the two sides, opposing each other in the axial direction of the plate cylinder 10, of the exposure unit 39.

In this arrangement, the exposure unit 39 is placed on the table 38 so as to be movable through the pipe 82 in the direction (direction of arrows A–B) to come close to-and separate from the plate cylinder 10. When the driving means (not shown) is actuated to clamp the exposure unit 39 and table 38 with the clamp plates 84, the exposure unit 39 is fixed on the table 38. The pair of screw holes 38*b* to threadably engage with thumbscrews 93 are formed in one end face of the table 38.

An adjuster 85 is comprised of a rectangular parallelepiped stationary member 86, an almost cubic movable member 87 movable in the direction of arrows A–B, and a differential screw 90 which can move the movable member 87 with respect to the stationary member 86. A pair of guide members 94A and 94B oppose each other at a gap slightly larger than the width of the movable member 87, and form a U shape together with an attaching plate 95. The guide members 94A and 94B are fixed to the rear end face of the stationary member 86 with screws. The differential screw 90 has a threaded portion 88 and a threaded portion 89 integrally formed at the distal end of the threaded portion 88 and with a pitch smaller than that of the threaded portion 88. A handle 91 is integrally attached to the proximal end of the threaded portion 88.

The threaded portion 88 of the differential screw 90 extends through a screw hole in the movable member 87 to threadably engage with it, and the threaded portion 89 threadably engages with a screw hole in the stationary member 86. The movable member 87 is guided in the direction of arrows A–B such that it is sandwiched between the guide members 94A and 94B. A pair of spacers 92 are attached to the front end of the stationary member 86. The thumbscrews 93 threadably engage with the screw holes of the stationary member 86 to extend through them. A screw 96 threadably engages with the screw hole of the movable member 87 to extend through it.

In this arrangement, when the respective thumbscrews 93 are threadably engaged with the screw holes 38*b* of the table 38, the stationary member 86 is fixed to the table 38. When the screw 96 is threadably engaged with the screw hole 82*a* of the pipe 82, the movable member 87 and pipe 82 are integrated with each other. The clamp plates 84 are released, the exposure unit 39 is set movable in the direction of arrows A–B with respect to the table 38, and the handle 91 is rotated clockwise.

The pitch of the threaded portion 88 threadably engaging with the movable member 87 is larger than that of the threaded portion 89 threadably engaging with the stationary member 86, and the stationary member 86 is fixed to the table 38. Thus, the moving amount of the movable member 87 in the direction B with respect to the threaded portion 88 is larger than that of the threaded portion 88 in the direction A, so the movable member 87 slightly moves in the direction of arrow B. At this time, the pipe 82 integrated with the movable member 87 also slides in the groove 81 to slightly move in the direction of arrow B. Thus, the exposure unit 39 to which the pipe 82 is fixed also slightly moves in the direction of arrow B, so that it is finely adjusted with respect to the table 38 in the direction (direction of arrows A–B) to come close to and separate from the plate cylinder 10.

If the pitch of the threaded portion 88 threadably engaging with the movable member 87 is smaller than that of the threaded portion 89 threadably engaging with the stationary member 86, as the handle 91 is rotated clockwise, the movable member 87 moves in the direction A. Thus, the exposure unit 39 is finely adjusted in the direction A.

The plate making operation of the printing press with the above arrangement will be described.

First, as shown in FIG. 4B, the opening 22 of the printing unit 4-2 is opened to allow plate change or maintenance of the inking unit and the like. At this time, the plate making unit 35 is separate from the printing press 1 in the direction of arrow B, and is located at the opposite side in the work space 8-2, i.e., at the wait position (inoperative position) indicated by the alternate long and two short dashed line in FIG. 7A. At the wait position, as the plate making unit ON/OFF detection sensors 25A and 25B do not detect the detection target members 78A and 78B, the control unit 6 controls the printing press 1 in a state wherein its operation at the first speed is disabled, i.e., a state wherein normal printing cannot be performed.

When the castors 53A and 53B roll in the guide grooves 26*a* of the guide members 26A and 26B, the plate making unit 35 moves from the wait position in the direction of arrow A, and is positioned at the operative position indicated by the solid line in FIG. 7A. At this time, the head 40 comes close to the outer surface of the plate cylinder 10, and plate making operation is enabled. At the operative position, the engaging recesses 49 of the engaging blocks 48A and 48B of the plate making unit 35 respectively engage with the engaging pins 29A and 29B of the frames 9A and 9B, as shown in FIG. 7A, to position the plate making unit 35 in the vertical (up-and-down) direction.

Simultaneously, the distal end portion 50*a* of the engaging pin 50 of the plate making unit 35 engages with the engaging recess 32 of the engaging block 31 of the frame 9A. Since the engaging recess 32 extends in the vertical direction as described above, the engaging pin 50 of the plate making unit 35 is allowed to move along the engaging recess 32 in the vertical direction. Hence, the engaging blocks 48A and 48B and engaging pins 29A and 29B correctly position the plate making unit 35 in the vertical direction.

When positioning the plate making unit 35 in the vertical direction, even if it moves (is positionally shifted) in the vertical direction, the compression coil springs 58 absorb this movement (positional shift). Hence, the plate making unit 35 can be positioned by only moving it to the operative position. This improves the plate making precision and printing precision, and greatly reduces the load of the operator and preparation time, thereby increasing the productivity.

When the distal end portion 50*a* of the engaging pin 50 of the plate making unit 35 engages with the engaging recess 321of the engaging block 31 of the frame 9A, the plate making unit 35 is positioned in the axial direction of the plate cylinder 10. At this time, as shown in FIG. 7A, the engaging recesses 49 of the engaging blocks 48A and 48B of the plate making unit 35 engage with the engaging pins 29A and 29B of the frames 9A and 9B. Since the engaging recesses 49 extend in the axial direction of the plate cylinder 10 as described above, the plate making unit 35 is allowed to move such that its engaging recesses 49 slide on the engaging pins 29A and 29B of the frames 9A and 9B.

As shown in FIG. 10C, a play corresponding to the distance 2δ is set between the engaging wheel 53*a* of the castor 53B and the guide groove 26*a*. Accordingly, when positioning the plate making unit 35 in the axial direction of the plate cylinder 10, even if it moves (is positionally shifted) in the axial direction of the plate cylinder 10, the engaging blocks 48A and 48B are allowed to move in the same direction, and the movement itself is absorbed by the play 2δ.

Thus, the plate making unit 35 can be positioned by only moving it to the operative position. This improves the plate making precision and printing precision, and greatly reduces the load of the operator and preparation time, thereby increasing the productivity. If the verticality of the plate making unit 35 need be adjusted, the engaging pin 50 is rotated to move the distal end portion 50*a* forward/backward.

When the plate making unit 35 is positioned at a position where it can perform plate making, the plate making unit ON/OFF detection sensors 25A and 25B oppose the detection target members 78A and 78B, as shown in FIG. 7A. In this state, the plate making unit ON/OFF detection sensors 25A and 25B detect that the plate making unit 35 is positioned at the operative position. When it is detected that the plate making unit 35 is at the operative position, the control unit 6 drives the actuators 60A and 60B, supported by the base frame 43, to move the rods 64 backward, as shown in FIG. 9. When the rods 64 move backward, the hooks 65*a* of the levers 65 engage with the engaging projections 30A and 30B of the frames 9A and 9B. Hence, at the operative position, the plate making unit 35 is fixed to the frames 9A and 9B.

At this time, the fixed state detection sensors 63*a* of the actuators 60A and 60B detect that the plate making unit 35 is fixed, and output detection signals to the control unit 6. Based on the detection signals from the fixed state detection sensors 63*a* and detection signals from the plate making unit ON/OFF detection sensors 25A and 25B, the control unit 6 determines that the plate making unit 35 is in the plate making possible state and the printing possible state, i.e., that the plate making unit 35 can be operated at the first speed. In this manner, since the plate making unit ON/OFF detection sensors 25A and 25B and fixed state detection sensors 63*a* arranged above and under the plate making unit 35 detect the plate making possible state and printing possible state, the plate making unit at the operative position is reliably positioned in the vertical direction.

Figure 13A:
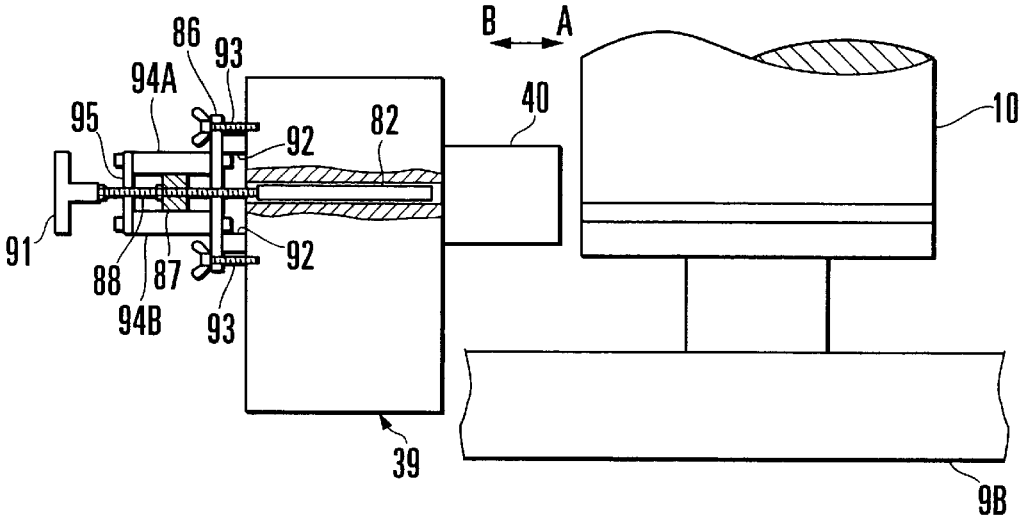
FIGS. 13A and 13B are a partially cutaway plan view and partially cutaway side view, respectively, of the position adjusting mechanism of the exposure unit.
Figure 13B:
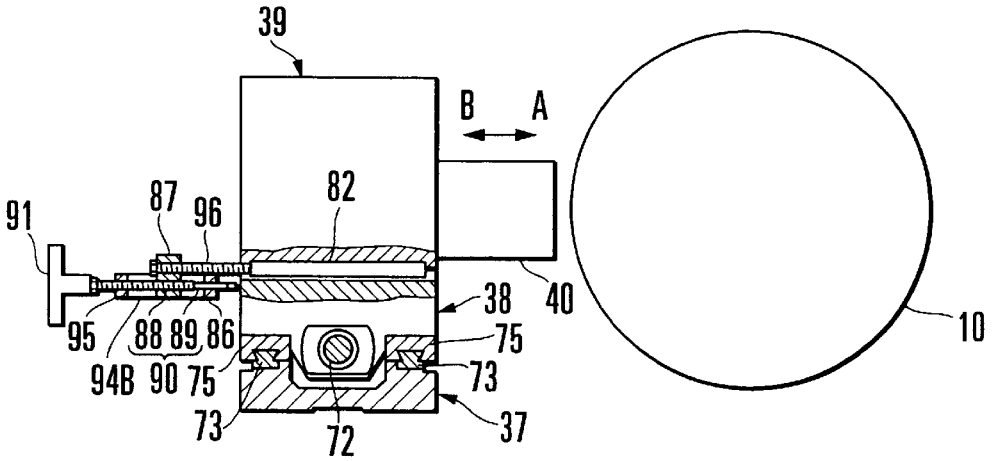

When the distance between the head 40 and the outer surface of the plate cylinder 10 need be adjusted, the exposure unit 39 is finely adjusted by moving it with respect to the table 38 in the direction of arrows A–B by using the adjuster 85 shown in FIGS. 13A, 13B, and 14. Subsequently, the driving means (not shown) is driven to clamp the table 38 and exposure unit 39 with the clamp plates 84, thereby fixing the exposure unit 39 to the table 38. When the exposure unit 39 is fixed to the table 38 in this manner with the clamp plates 84, the distance between the head 40 and plate cylinder 10 which is adjusted once is maintained during plate making operation, so defective plate making is prevented.

Subsequently, the thumbscrews 93 and the screw holes 38*b* of the table 38 are disengaged from each other, and the screw 96 and the screw hole 82*a* of the pipe 82 are disengaged from each other, so the adjuster 85 is removed from the table 38 and exposure unit 39. Since the adjuster 85 is removable in this manner, the plate making units 35 of the plurality of printing units 4-1 to 4-4 can be adjusted with one adjuster 85. Thus, the cost is reduced, and the number of adjusters 85 that need management is reduced.

When an exposure start button (not shown) is operated, as the control unit 6 already recognizes that plate making is possible, it outputs a plate making operation start signal to the motor 71 (FIG. 3). The motor 71 drives the ball screw 72 to rotate in the forward direction. The exposure unit 39 is thus guided along the rails 73 to move from the position indicated by the alternate long and two short dashed line in the direction of arrow D. When the exposure unit home position sensor 76 detects the home position dog 27, rotation of the motor 71 is temporarily stopped, and the exposure unit 39 is positioned at the home position.

When the exposure unit 39 is positioned at the home position, the motor 71 rotates in the reverse direction to move the exposure unit 39 in the direction of arrow C. Thus, the head 40 performs plate making for the plate mounted on the plate cylinder 10. When the exposure unit 39 is positioned at the position indicated by the alternate long and two short dashed line, the motor 71 is driven in the forward direction again, and the exposure unit 39 moves in the direction of arrow D. When the exposure unit home position sensor 76 detects the home position dog 27, the exposure unit 39 is positioned at the home position again.

In this manner, since the home position dog 27 is fixed to the frame 9A and the exposure unit home position sensor 76 is fixed to the table 38, the position of the head 40 in the axial direction of the plate cylinder 10 can be detected with reference to the frame 9A. Accordingly, the position of the head 40 can be detected correctly without being influenced by the position precision of the plate making unit 35 at the operative position and the position precision of the head 40 with respect to the plate making unit 35. As a result, high-precision plate making is enabled, and the printing quality is improved.

Since the plate making unit 35 is provided to each of all the printing units 4-1 to 4-4, in each of the printing units 4-1 to 4-4, the position of the head 40 is detected with reference to the frame 9A. Therefore, the register accuracy is improved, and the complicated, skilled operation by the operator of adjusting the positions of the plate cylinders 10 for the purpose of registration is reduced, greatly reducing the load of the operator. Also, the preparation time can be greatly shortened, and the productivity is increased.

After plate making, a print start button (not shown) is operated with the plate making unit 35 being located at the operative position. As the control unit 6 already recognizes that printing is possible, it starts printing operation. At this time, the plate making unit 35 closes the opening 22 of the printing unit 4-2, as shown in FIG. 2A. In other words, the plate making unit 35 functions as a safety cover, so an exclusive safety cover need not be provided.

As a result, since an openable safety cover is not necessary, the structure is simplified. Since the space in front of the printing unit 4-2 is not narrowed more than necessary, the plate change operation and maintenance workability increase. Since the control unit 6 controls the printing press 1 in the plate making possible state and printing possible state on the basis of both the detection signal from the fixed state detection sensor 63*a* and the detection signals from the plate making unit ON/OFF detection sensors 25A and 25B, the plate making operation and printing operation are performed reliably.

When plate change or maintenance of the rollers or the like is to be performed, in FIG. 2A, the plate making unit 35 is moved from the operative position indicated by the solid line in the direction of arrow B and is positioned at the position indicated by an alternate long and two short dashed line. At this time, the detection switch 24 detects the notch 79*a* of the cam 79, so it is detected that the plate making unit 35 is positioned at the inoperative position. On the basis of the detection signal from the detection switch 24, the control unit 6 controls the printing press 1 to enable plate change and maintenance.

When a plate change button (not shown) is operated to change the plate, the driving means (not shown) positions the levers 15 at the guide position indicated by the alternate long and two short dashed line, as shown in FIG. 2A. The trailing edge plate clamping unit 13 of the plate cylinder 10 releases the plate. The plate cylinder 10 rotates through substantially one revolution clockwise in FIG. 2A, and the plate is released by the leading edge plate clamping unit 12. Thus, the old plate 23B is removed from the plate cylinder 10 through the opening 22 of the printing unit 4-2 while it is guided by the guide rollers 17.

When the leading edge of the new plate 23A supported by the legs 19*a* of the new plate mounting guide member 19 is inserted in the leading edge plate clamping unit 12, the leading edge plate clamping unit 12 closes to clamp the new plate 23A. The levers 15 pivot slightly clockwise in FIG. 2A and, with the guide rollers 17 being positioned at the plate mounting position indicated by the alternate long and short dashed line, the plate cylinder 10 rotates substantially through one revolution counterclockwise. Thus, the trailing edge of the new plate 23A is inserted in the trailing edge plate clamping unit 13. The trailing edge plate clamping unit 13 closes to clamp the trailing edge of the new plate 23A, so the new plate 23A is mounted on the outer surface of the plate cylinder 10.

In this manner, when the detection switch 24 detects that the plate making unit 35 is positioned at the inoperative position separate from the plate cylinder 10, plate change operation is enabled. The old plate 23B to be removed and the new plate 23A to be supplied will not damage the head 40 or the like, and will not scratch the surface of the new plate 23A.

When maintenance of the rollers or the like is to be performed, a tool or the like is inserted through the opening 22 which is opened when the plate making unit 35 is positioned at the inoperative position, and maintenance is performed. In this manner, when it is detected that the plate making unit 35 is at the inoperative position, the control unit 6 performs control operation to enable plate change operation and maintenance. Thus, plate change operation and maintenance can be performed reliably.

Figure 15B:
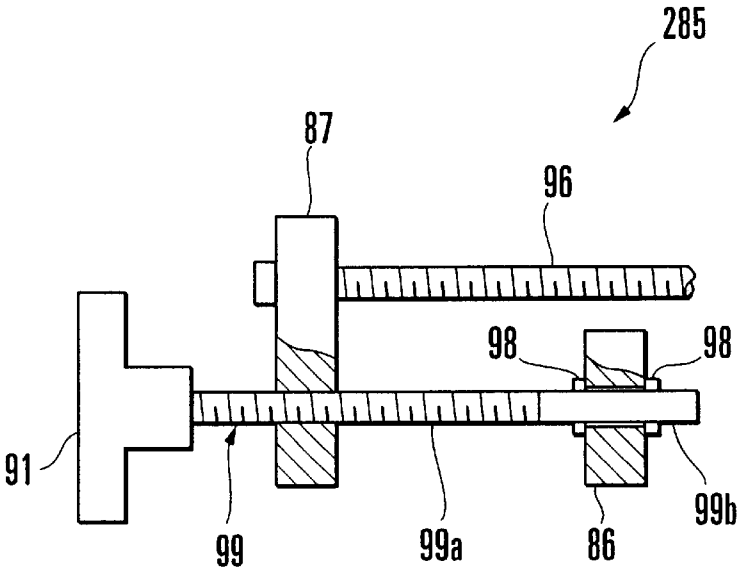
FIGS. 15A and 15B are front views showing the position adjusting mechanism of the exposure unit according to other examples.
Figure 15A:
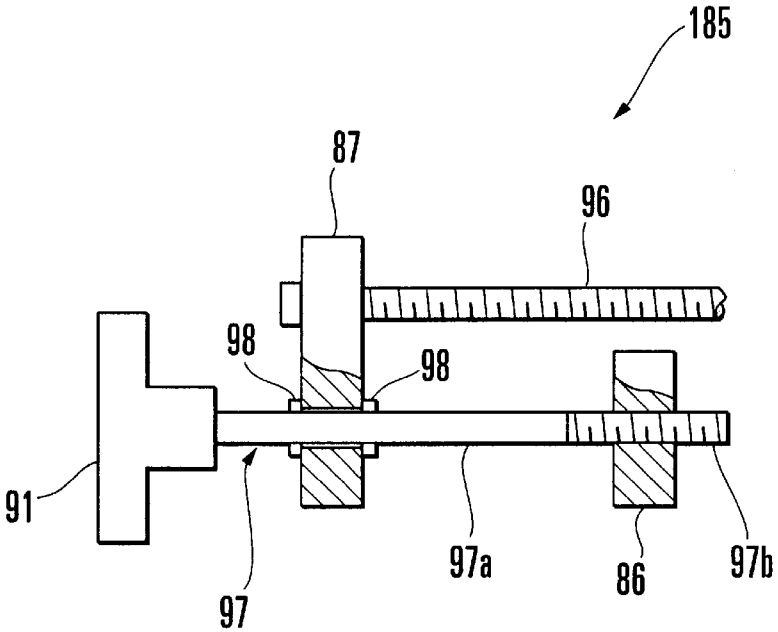

FIGS. 15A and 15B show modifications of the adjuster. An adjuster 185 shown in FIG. 15A uses, in place of the differential screw 90 shown in FIG. 14, a shaft 97 having a shaft portion 97*a* and a threaded portion 97*b* formed at the distal end of the shaft portion 97*a*. The shaft portion 97*a* of the shaft 97 loosely extends through a hole in a movable member 87 that fixes and holds the screw 96, and the threaded portion 97*b* of the shaft 97 threadably engages with a hole in a stationary member 86 to be fixed by it. A pair of fixing rings 98 fixed to the shaft portion 97*a* to correspond to the two surfaces of the movable member 87 regulate the movable member 87 from moving in the axial direction of the shaft portion 97*a*.

In the adjuster 185 with the above arrangement, when the handle 91 is rotated, the shaft 97 moves in a direction to come close to or separate from the exposure unit 39. Accordingly, the movable member 87 supported by the shaft portion 97*a*, and the screw 96 also move in the direction to come close to or separate from the exposure unit 39, thereby finely adjusting the exposure unit 39 with respect to the new plate 23A mounted on the plate cylinder 10.

An adjuster 285 shown in FIG. 15B uses, in place of the differential screw 90 shown in FIG. 14, a shaft 99 having a threaded portion 99*a* and a shaft portion 99*b* formed at the distal end of the threaded portion 99*a*. The threaded portion 99*a* of the shaft 99 threadably engages with the movable member 87 that fixes and holds the screw 96, and the shaft portion 99*b* of the shaft 99 loosely extends through a hole in a stationary member 86. A pair of fixing rings 98 fixed to the shaft portion 99*b* to correspond to the two surfaces of the stationary member 86 regulate the shaft 99 from moving in its axial direction.

In the adjuster 285 with the above arrangement, when the handle 91 is rotated, the shaft 99 rotates without moving in the axial direction. As the threaded portion 99*a* rotates, the movable member 87 and screw 96 are fed in the direction to come close to or separate from the exposure unit 39, thereby finely adjusting the exposure unit 39 with respect to the new plate 23A mounted on the plate cylinder 10.

In the above embodiment, the opening 22 of each of the printing units 4-1 to 4-4 is entirely closed with the plate making unit 35. However, the opening 22 need not always be entirely closed. It suffices as far as at least the necessary minimum part of the opening 22 is closed.

Although the engaging recesses 49 of the engaging blocks 48A and 48B and the engaging recess 32 of the engaging block 31 are formed with a V shape, they may alternatively be formed with a U shape. It suffices as far as the distance between the slant surfaces 49*a* and 49*b* gradually decreases toward the inner part of the recess.

The engaging pins 29A and 29B are provided to the frames 9A and 9B, and the engaging blocks 48A and 48B are provided to the plate making unit 35. Alternatively, the engaging pins 29A and 29B may be provided to the plate making unit 35, and the engaging blocks 48A and 48B may be provided to the frames 9A and 9B. Similarly, the engaging pin 50 may be provided to the frame 9A, and a second engaging block 31 may be provided to the plate making unit 35.

As has been described above, according to the present invention, since the position of the head with respect to the plate cylinder can be adjusted by the adjuster, the position of the head with respect to the plate cylinder can be adjusted, so defective plate making can be prevented. In addition, since the adjuster can be attached to/detached from the plate making unit, the adjuster can be removed from the plate making unit after adjustment completion, and the operation space of the operator is not narrowed. The adjuster is not contained but is attached to/detached from the plate making unit, thereby downsizing the plate making unit. The plate making units of the plurality of printing units can be adjusted with one adjuster, thereby reducing the cost and the time consumed by managing the adjuster.

What is claimed is:

1. A printing press comprising:

a frame;

a plate cylinder which is rotatably supported by the frame and has an outer surface on which a plate is mounted;

a plate making unit for performing plate making for the plate mounted on said plate cylinder, said plate making unit having a support member supported by the frame and an exposure unit supported by said support member to be movable in a direction to come close to and separate from the outer surface of said plate cylinder, said exposure unit being provided with a head which irradiates the plate with a laser beam to print an image on the plate;

fixing means for fixing said exposure unit to said support member; and an adjuster adjusts a position of said exposure unit which is released from said support member when said adjuster is coupled to said plate making unit for adjustment, after completion of adjustment said exposure unit is fixed to said support member by said fixing means and said adjuster is detached from said plate making unit.

2. The printing press according to claim 1, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and adjustment differential screws having difference pitches to threadably engage with said fixing member and said movable member.

3. The printing press according to claim 2, further comprising a handle integrally formed with said differential screws to rotate said differential screws.

4. The printing press according to claim 1, wherein said support member comprises a support table, and said adjuster is detachably fixed to a side surface of said support table.

5. The printing press according to claim , further comprising:

a first groove portion formed on a lower portion of said exposure unit in a direction perpendicular to an axial direction of said plate cylinder;

a cylindrical member fixed in said first groove; and a V-shaped second groove formed in correspondence with said first groove in a surface of said support table, in which said cylindrical member slides.

6. The printing press according to claim wherein said exposure unit is detachably placed on said support table by positioning said cylindrical member in said second groove.

7. The printing press according to claim 1, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and a shaft having a threaded portion threadably engaging with said movable member and a shaft portion loosely extending through a through hole of said fixing member, the shaft portion being regulated from moving in an axial direction with respect to said fixing member.

8. The printing press according to claim 1, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and a shaft having a shaft portion loosely extending through a through hole of said movable member and a threaded portion threadably engaging with said fixing member, said movable member being regulated from moving in an axial direction of the shaft portion.

9. A printing press comprising:

a frame;

a plate cylinder which is rotatably supported by the frame and has an outer surface on which a plate is mounted;

a plate making unit for performing plate making for the plate mounted on said plate cylinder, said plate making unit having a support member supported by the frame and an exposure unit supported by said support member to be movable in a direction to come close to and separate from the outer surface of said plate cylinder, said exposure unit being provided with a head which irradiates the plate with a laser beam to print an image on the plate; and an adjuster supported by said plate making unit to be detachable to adjust a position of said exposure unit with respect to said support member, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and adjustment differential screws having difference pitches to threadably engage with said fixing member and said movable member.

10. A printing press comprising:

a frame;

a plate cylinder which is rotatably supported by the frame and has an outer surface on which a plate is mounted;

a plate making unit for performing plate making for the plate mounted on said plate cylinder, said plate making unit having a support member supported by the frame and an exposure unit supported by said support member to be movable in a direction to come close to and separate from the outer surface of said plate cylinder, said exposure unit being provided with a head which irradiates the plate with a laser beam to print an image on the plate; and an adjuster supported by said plate making unit to be detachable to adjust a position of said exposure unit with respect to said support member, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and a shaft having a shaft portion loosely extending through a through hole of said movable member and a threaded portion threadably engaging with said fixing member, said movable member being regulated from moving in an axial direction of the shaft portion.

11. A printing press comprising:

a frame;

a plate cylinder which is rotatably supported by the frame and has an outer surface on which a plate is mounted;

a plate making unit for performing plate making for the plate mounted on said plate cylinder, said plate making unit having a support member supported by the frame and an exposure unit supported by said support member to be movable in a direction to come close to and separate from the outer surface of said plate cylinder, said exposure unit being provided with a head which irradiates the plate with a laser beam to print an image on the plate; and an adjuster supported by said plate making unit to be detachable to adjust a position of said exposure unit with respect to said support member, wherein said support member and said exposure unit have screw holes, and said adjuster includes a fixing member which is threadably engaged with said screw hole of said support member and detachably attached, and fixed to said support member while threadably engaging with said screw hole, a movable member supported to said fixing member to be movable, said movable member being threadably engaged with said screw hole of said exposure unit and detachably attached, and fixed to said exposure unit while threadably engaging with said screw hole, and a shaft having a threaded portion threadably engaging with said movable member and a shaft portion loosely extending through a through hole of said fixing member, the shaft portion being regulated from moving in an axial direction with respect to-said fixing member.

* * * * *